United States Patent [19]

Torre et al.

[11] Patent Number: 4,963,880

[45] Date of Patent: Oct. 16, 1990

[54] COPLANAR SINGLE-COIL DUAL FUNCTION TRANSMIT AND RECEIVE ANTENNA FOR PROXIMATE SURVEILLANCE SYSTEM

[75] Inventors: John J. Torre, Monroe, N.Y.; Michael Drummy, Stanhope, N.J.

[73] Assignee: Identitech, Essex, N.J.

[21] Appl. No.: 315,233

[22] Filed: Feb. 23, 1989

Related U.S. Application Data

[63] Continuation of Ser. No. 189,861, May 3, 1988, abandoned.

[51] Int. Cl.[5] ..... H01Q 7/00

[52] U.S. Cl. ..... 343/866; 343/868; 343/787; 343/876; 340/572

[58] Field of Search ..... 343/866, 895, 876, 787, 343/788, 868, 748; 340/572

[56] References Cited

U.S. PATENT DOCUMENTS

| | | | |
|---|---|---|---|
| 3,631,442 | 12/1971 | Fearon | 340/572 |
| 3,754,226 | 8/1973 | Fearon | 343/788 |
| 3,790,945 | 2/1974 | Fearon | 340/572 |
| 4,016,553 | 4/1977 | Novikoff et al. | 340/572 |
| 4,622,543 | 11/1986 | Anderson, III et al. | 340/572 |

*Primary Examiner*—Rolf Hille
*Assistant Examiner*—Hoanganh Le
*Attorney, Agent, or Firm*—Robin, Blecker, Daley & Driscoll

[57] ABSTRACT

A coplanar antenna system having a single-coil loop antenna provides both transmit and receive functions. The antenna operates in a tuned mode during transmitting and an untuned mode during receiving. Dead zone and transformer effect problems are virtually eliminated. The transmitter is highly efficient and the receiver is impulse noise immune.

2 Claims, 1 Drawing Sheet

COPLANAR SINGLE-COIL DUAL FUNCTION TRANSMIT AND RECEIVE ANTENNA FOR PROXIMATE SURVEILLANCE SYSTEM

This application is a continuation of application Ser. No. 189,861, filed May 3, 1988, now abandoned.

BACKGROUND OF THE INVENTION

1. FIELD OF THE INVENTION

This invention relates to article surveillance systems, and more particularly to a proximate surveillance system having a single coil, coplanar antenna which enhances the sensitivity and reliability of the system.

2. DESCRIPTION OF THE PRIOR ART

Coplanar antenna proximate surveillance systems have been disclosed for use in article surveillance systems. They function to remind a cashier or sales clerk to remove a magnetic marker from a purchased item before it is carried through a theft detecting interrogation zone provided near the egress of an area appointed for surveillance.

Generally, coplanar antenna proximate surveillance systems use separate transmit and receive antennae. A major problem with such systems is the tendency of the receive antenna to generate a magnetic field which opposes the magnetic field generated by the transmit antenna. The presence of the opposing magnetic fields, sometimes referred to as the "transformer effect", arises from the transformer action (magnetic coupling between the transmit and receive antenna coils.

One means for reducing the transformer effect, involves the incorporation of a "figure 8" type transmit antenna with a receive antenna centered thereabout. This means affords some reduction of the transformer effect, but creates a dead zone in the area perpendicular to and near the center of the "figure 8" antenna such that the magnetic marker can pass through the interrogation zone undetected.

SUMMARY OF THE INVENTION

The present invention provides a proximate surveillance system having a coplanar single coil transmit and receive loop antenna that virtually eliminates the transformer effect problem and minimizes the dead zone effect. Generally stated, a single antenna coil is utilized as both the transmitting and receiving means. During a transmitter interval, there is no opposing magnetic field generated, since generation of such a field would require a second coil magnetically coupled to the transmit coil.

In addition, by not using a "figure 8" type transmit antenna, there is no dead zone created by the transmit antenna. There are reduced sensitivity zones for markers parallel to the plane and near the center of the antenna. But fringing effects make these reduced sensitivity zones difficult to find.

Changeover from transmit to receive mode of the antenna is effected by operating the antenna in a tuned mode during transmitting and an untuned mode during receiving. As a result, the transmitter is more efficient and the receiver is more impulse noise immune than in systems wherein the transmit and receive antennae are separate.

DESCRIPTION OF THE PREFERRED EMBODIMENTS

Figure 1:
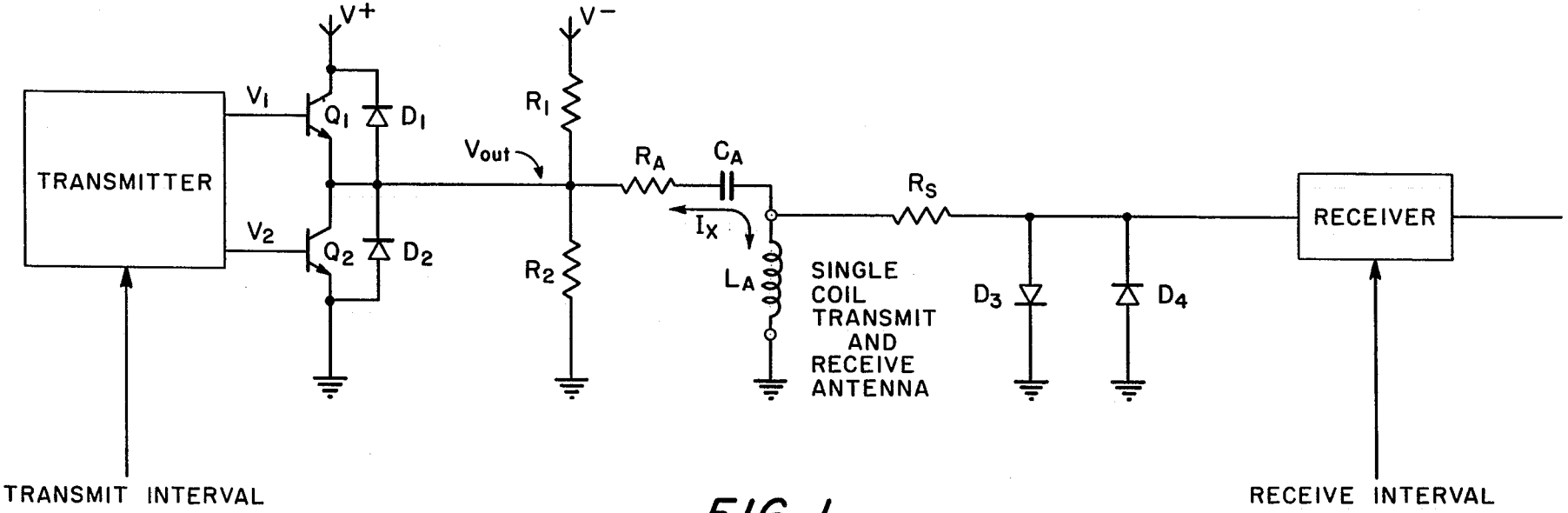
FIG. 1 is a schematic circuit diagram showing the system transmitter, single-coil transmit and receive antenna, and system receiver.

Referring to FIG. 1 of the drawings, there is shown the connections to the single-coil transmit and receive antenna. During a transmitter interval, the antenna inductance $L_a$ together with tuning capacitor $C_a$ and resistor $R_a$, forms a series resonant tuned RLC circuit.

When driven by the switched-mode transmitter stage, the squarewave output voltage, $V_{out}$, results in the generation of a sinusoidal transmit antenna current, $I_x$, due to the filtering action of the antenna circuit.

Figure 2:
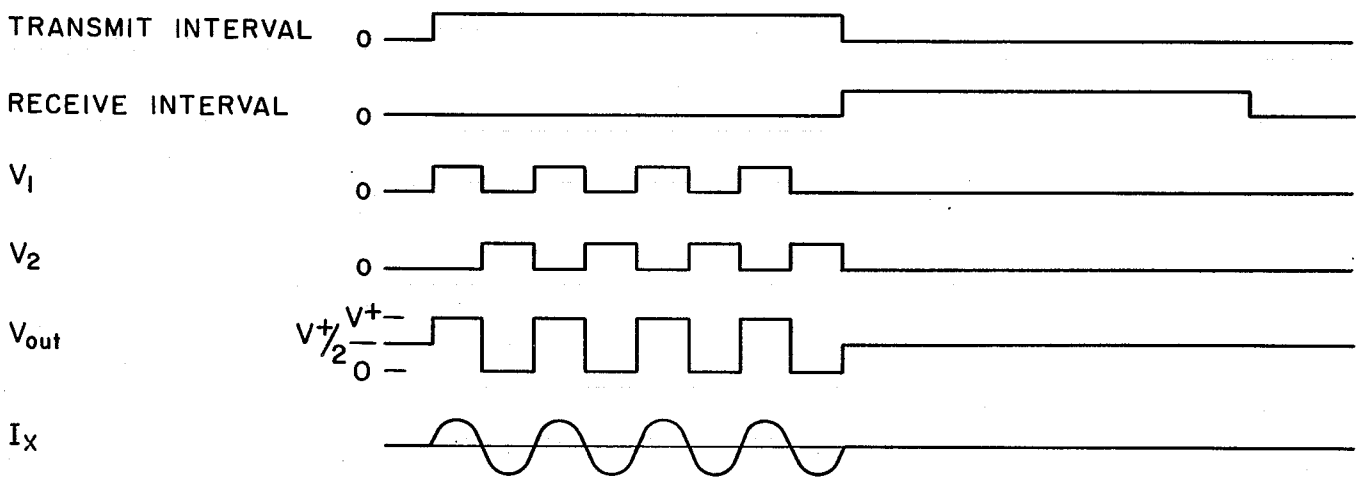
FIG. 2 shows waveforms illustrative of those generated during operation of the system of FIG. 1.

The operation of the switched-mode transmitter stage is illustrated by the waveforms shown in FIG. 2. By switching transistors $Q_1$ and $Q_2$ ON and OFF on an alternating basis (one on while other is off), a squarewave output voltage at the switching frequency (frequency of $V_1$ and $V_2$), is generated.

Utilizing the voltage divider arrangement consisting of resistors $R_1$ and $R_2$, the circuit can be operated from a single-power supply V+, with the antenna coil driven in a single-ended mode (one side of antenna coil grounded).

The transmitter output stage utilizes commutation diodes $D_1$ and $D_2$ across transistors $Q_1$ and $Q_2$, respectively. These diodes provide conduction paths for the transmitter current $I_x$ during the short time periods (dead time) that both $Q_1$ and $Q_2$ are off. In addition, when the switching frequency is less than or greater than the actual antenna circuit resonant frequency (due to antenna circuit tolerances) both $D_1$ and $D_2$ conduct the leading or lagging $I_x$ current, respectively.

Since the antenna coil has one side at a ground potential common to both transmitter and receiver, detecting a receive signal induced in the coil does not require any type of isolation stage.

The switched-mode output stage of the transmitter in its OFF state (non-transmitting mode), provides a built-in disconnect switch for the antenna coil during receive intervals by virtue of its tri-state operating characteristic. Thus, during receive intervals, the antenna circuit is essential open circuited, except for the equivalent circuit formed by resistors $R_1$ and $R_2$ in parallel. By choosing values for $R_1$ and $R_2$ large enough, the Q of the antenna circuit is reduced such that the antenna is essentially untuned.

The circuit consisting of resistor $R_s$ and diodes $D_3$ and $D_4$ form a limiter network to protect the receiver input from the high potential voltage present across the antenna coil during transmitting.

During the receiver interval, the untuned antenna offers more impulse noise immunity than that of a tuned antenna circuit providing that the system is designed to maximize the impulse noise immunity of the receiver means itself.

The antenna circuit elements are chosen to provide efficient transmit and receive functions using practical circuit component values.

The antenna coil itself is typically a 10" diameter loop antenna consisting of a total of 15 turns. This results in an antenna coil inductance "La" of approximately 140 uh.

The series resonating tuning capacitor, "Ca" is chosen to resonate (tune) the antenna circuit at the desired operating frequency.

Typically, the series resonating tuning capacitor, Ca, operates at 58 kHz, resulting in a Ca value equal to 0.57 uf. Since, in many cases, the design value of Ca is not a standard value, the antenna circuit contains provisions for accommodating at least two Ca components. These Ca components, when connected in parallel, can achieve the desired net value for operating at a specific frequency.

The antenna series resistor "Ra" is chosen so that the antenna current and circuit "Q" can be controlled. The antenna current is also a direct function of the transmitter power supply voltage V+. Typical values for all of these are V+=20 v, and Ra=20 ohms resulting in a peak current and circuit Q of 0.5 and 2.5, respectively.

Resistors R1 and R2 are equal values and chosen to keep the output impedance of the transmitter driver high, during non-transmit intervals, with respect to its on-state output impendance. During non-transmit intervals, the transistors Q1 and Q2 are both in their off state. As a result, the antenna circuit impedance looking into the transmitter output consists of the parallel circuit formed by R1 and R2. Typical values for both R1 and R2 are 20 k, resulting in a 10 k ohms output impendance during transmitter off periods. Therefore, the antenna circuit is essentially open circuited with respect to the transmitter on period circuit impedance which is essentially equal to Ra (20 ohms).

Diodes D1 and D2 are normally incorporated within the transmitter driver device and have voltage and current rating equivalent to those of the transmitter driver transistors Q1 and Q2. The receiver input limiter circuit consisting of resistor Rs and diodes D3 and D4 are chosen to minimize loading of the antenna coil while protecting the input of the receiver circuit from the potential voltage across the antenna coil present during transmit periods. This voltage is equal to the product of the antenna coil transmit current "Ix" and the antenna coil impendance "XLa". For the typical values previously described, this voltage is approximately 25 v pk (0.5 a×50). Choosing resistor Rs equal to at least 100 times the antenna coil impendance (100×50 ohms), in this case 5 k, results in negligible antenna coil loading.

Limiter diodes D3 and D4 only need to safely handle the actual current flow through them during transmit periods. For the typical values previously described, this current is approximately equal to 25 v/5000 ohms=5 ma pk.

Having thus described the invention in rather full detail, it will be understood that such detail need not be strictly adhered to but that various changes and modifications may suggest themselves to one skilled in the art, all falling within the scope of the invention as defined by the subjoined claims.

What is claimed is:

1. A single coil, dual function coplanar antenna system having transmit and receive intervals during which magnetic field components are transmitted and received, respectively, within a region proximate the antenna system, comprising:

(a) a single coil having a perimeter and enclosing a unique region;

(b) means for driving said coil during said transmit intervals to generate and transmit time varying magnetic field components within said proximate region, said coil upon being driven on, producing components vertical and horizontal to the plane of the coil, which components are the result of fringing effects within the area approximated by the coil perimeter;

(c) means utilizing said coil during said receive intervals for receiving and detecting magnetic field components within said proximate region and having a preselected net resultant magnetic field;

(d) circuit means connected to said coil for forming with said coil, during said transmit intervals, a series resonant tuned circuit and, during said receive intervals, an untuned circuit; and (e) tri-state output switched-mode operating means connected to said circuit means for providing an intrinsic automatic changeover of said circuit means between said tuned and untuned circuits.

2. A coplanar antenna system, as recited in claim 1, wherein said coil comprises a circular loop having a diameter of about 10 inches and about 15 turns total.

* * * * *